US010400528B2

(12) United States Patent
Kalia et al.

(10) Patent No.: US 10,400,528 B2
(45) Date of Patent: Sep. 3, 2019

(54) MODULAR MANIFOLD

(71) Applicant: OneSubsea IP UK Limited, London (GB)

(72) Inventors: Akshay Kalia, Houston, TX (US); Tyler Skowronek, Cypress, TX (US); Fernando Saenz, Richmond, TX (US); Adriano Pinho, Cypress, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 15/665,672

(22) Filed: Aug. 1, 2017

(65) Prior Publication Data

US 2018/0030796 A1 Feb. 1, 2018

Related U.S. Application Data

(60) Provisional application No. 62/369,607, filed on Aug. 1, 2016.

(51) Int. Cl.

| | |
|---|---|
| ***E21B 21/08*** | (2006.01) |
| ***E21B 43/12*** | (2006.01) |
| ***E21B 21/10*** | (2006.01) |
| ***E21B 43/017*** | (2006.01) |
| ***E21B 43/013*** | (2006.01) |
| *E21B 33/068* | (2006.01) |
| *E21B 34/02* | (2006.01) |
| *E21B 34/00* | (2006.01) |

(52) U.S. Cl.

CPC ..... *E21B 21/08* (2013.01); *E21B 43/12* (2013.01); *E21B 21/10* (2013.01); *E21B 33/068* (2013.01); *E21B 34/02* (2013.01); *E21B 2034/002* (2013.01)

(58) Field of Classification Search

None

See application file for complete search history.

(56) References Cited

U.S. PATENT DOCUMENTS 4,625,805 A * 12/1986 Ladecky ..... E21B 41/04 166/341
5,025,865 A * 6/1991 Caldwell ..... E21B 43/017 166/339

(Continued)

FOREIGN PATENT DOCUMENTS

GB 2174442 A 11/1986
GB 2195686 A 4/1988

OTHER PUBLICATIONS

Extended European Search Report issued in European Patent Appl. No. 171843493 dated Nov. 22, 2017; 6 pages.

*Primary Examiner* — Matthew R Buck
*Assistant Examiner* — Douglas S Wood
(74) *Attorney, Agent, or Firm* — Brandon S. Clark

(57) ABSTRACT

A technique facilitates controlling fluid flows with a modular manifold. The modular manifold has a manifold base which is positioned at a desired surface or subsea location. Various types of modular units may be deployed to and/or retrieved from the manifold base according to the desired control of fluid flows with respect to a well or a plurality of wells. Each modular unit may be selectively coupled or decoupled along the manifold base to adjust the configuration of the manifold for a given job or over time to accommodate changing conditions.

16 Claims, 8 Drawing Sheets

(56) References Cited

U.S. PATENT DOCUMENTS

| | | | | |
|---|---|---|---|---|
| 8,151,890 | B2 * | 4/2012 | Spencer | E21B 33/035 166/250.01 |
| 8,474,521 | B2 * | 7/2013 | Kajaria | E21B 43/26 166/177.5 |
| 9,605,525 | B2 * | 3/2017 | Kajaria | E21B 43/26 |
| 2015/0000766 | A1 | 1/2015 | Arizpe et al. | |
| 2018/0016877 | A1 * | 1/2018 | Radicioni | E21B 43/017 |
| 2018/0258742 | A1 * | 9/2018 | Sveberg | E21B 43/017 |

* cited by examiner

MODULAR MANIFOLD

CROSS-REFERENCE TO RELATED APPLICATION

The present document is based on and claims priority to U.S. Provisional Application Ser. No. 62/369,607, filed Aug. 1, 2016, which is incorporated herein by reference in its entirety.

BACKGROUND

In surface and subsea oil and gas production, many types of equipment are used to transfer and direct flows of fluids. For example, production fluids and/or injection fluids may be routed through manifold systems coupled with several different wells. The subsea or surface manifold systems generally are installed with multiple headers as a single unit. The single unit manifold tends to be large, heavy and complex. Consequently, substantial time and expense may be involved in deploying or retrieving the manifold. Such a system also involves substantial effort to effect a change in configuration of the manifold and may involve removal and replacement of the entire manifold. Additionally, manifold usage with respect to fluid production or other activity may change over the life of a field or project. However, the ability to reconfigure or retrofit the manifold to accommodate changing conditions is limited.

SUMMARY

In general, the present disclosure provides a system and methodology for controlling fluid flows with a modular manifold. The modular manifold has a manifold base which is positioned at a desired surface or subsea location. Various types of modular units may be deployed to and/or retrieved from the manifold base according to the desired control of fluid flows with respect to a well or a plurality of wells. Each modular unit may be selectively coupled or decoupled along the manifold base to adjust the configuration of the manifold for a given job or over time to accommodate changing conditions.

BRIEF DESCRIPTION OF THE DRAWINGS

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

Figure 1:
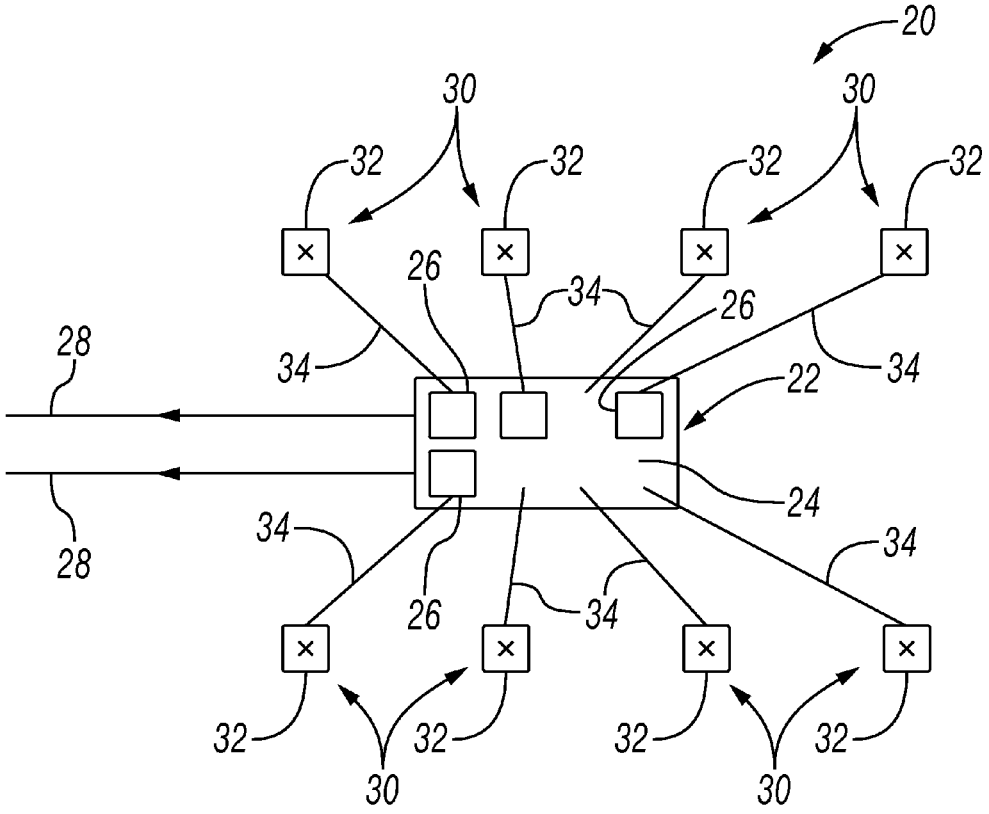
FIG. 1 is a schematic illustration of an example of a modular manifold operatively coupled with a plurality of wells, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology for controlling fluid flows with a modular manifold. The modular manifold may be constructed for use in surface well operations or subsea well operations to control flow of fluids between well system components. For example, the modular manifold may be used to control flow of production fluids from one or more wells and/or flow of injection fluids into one or more wells.

According to an embodiment, the modular manifold comprises a manifold base which is positioned at a desired surface or subsea location. Various types of modular units may be deployed to and/or retrieved from the manifold base according to the desired control of fluid flows with respect to a well or a plurality of wells. A manifold frame may be used with the base to help define spaces for receiving the modular units. Each modular unit may be selectively coupled or decoupled along the manifold base to adjust the configuration of the manifold for a given job or over time to accommodate changing conditions.

Depending on the parameters of a given operation, the manifold may be constructed with different numbers of modular units to control desired flows of fluid. By way of example, the modular manifold may be coupled to various types of flow lines, e.g. piping, which carry fluid flows to and/or from well installations or other well system components. The flow lines may be coupled to individual modular units or to couplings on the manifold base or manifold frame which, in turn, are fluidly coupled with the corresponding modular units.

By way of example, the modular units may comprise modular branch units, including multiple modular branch units, and modular header units. However, the modular units also may comprise communication modular units, metering modular units, sampling modular units, chemical injection modular units, pumping modular units, or other modular units which may be removably coupled into fluid communication with cooperating well system components.

The modular units may be individually installed and connected along the manifold base or individually disconnected and removed from the manifold base. This provides great operational flexibility compared to a conventional single unit type manifold. The modular manifold may be constructed in various embodiments which may be used in a wide variety of applications and industries, including the oil and gas industry, the marine industry, and other industries utilizing fluid flow control from and to related equipment.

In an oil and gas well application, for example, the modular manifold may have several modes of modularity. For example, the addition or removal of modular units may be used to increase or decrease flow capacity to or from different numbers of sources. Various numbers of modular branch units, multiple modular branch units, and/or modular header units may be added or removed from the manifold base to accommodate flow control with respect to different numbers of cooperating systems/installations.

Referring generally to FIG. 1, an example of a well system 20 is illustrated. The well system 20 may be a surface system or a subsea system. In the example illustrated, the well system 20 comprises a modular manifold 22 having a manifold base 24 along which a plurality of modular units 26 may be positioned. Each modular unit 26 is positioned to control, e.g. direct, fluid flow between components, e.g. between well system installations.

By way of example, each modular unit 26 may be placed in fluid communication with the manifold base 24 which, in turn, may be fluidly coupled with corresponding flow lines 28. However, individual modular units 26 may be coupled in direct fluid communication with flow lines 28 and/or with other modular units 26 or other components. In the illustrated embodiment, for example, the well system 20 comprises a plurality of wells 30 in fluid communication with well installations 32, e.g. wellheads and Christmas trees. If well system 20 is a subsea well system, the flow lines 28 may be routed to a surface facility, e.g. a surface vessel, or other suitable facility.

Individual modular units 26 may be coupled with corresponding well installations 32 via corresponding flow lines 34. However, the individual modular units 26 may be coupled with various other well system components in surface or subsea applications. Additionally, the modular manifold 22 may be used in a variety of non-well related applications.

Figures 2, 3, 4:
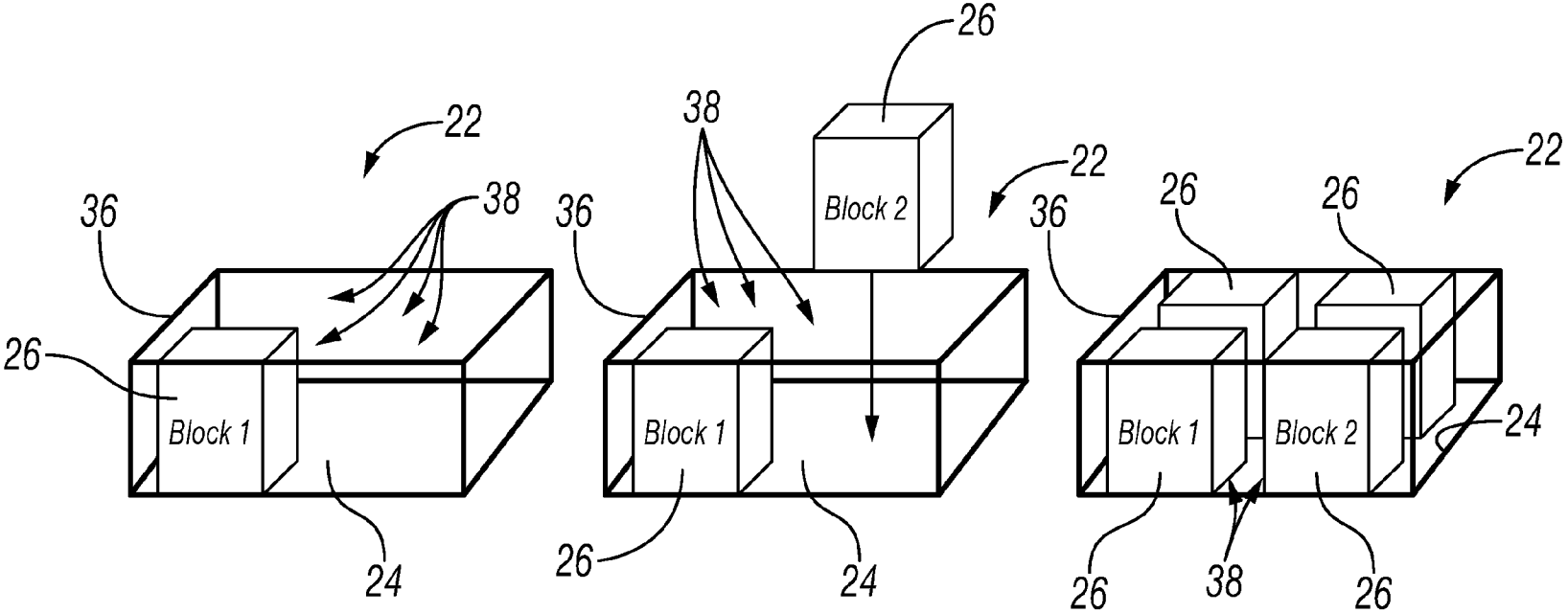
FIG. 2 is a schematic illustration of an example of a modular manifold having a single modular unit coupled to a manifold base, according to an embodiment of the disclosure.
FIG. 3 is a schematic illustration similar to that of FIG. 2 but showing a second modular unit being added into the modular manifold, according to an embodiment of the disclosure.
FIG. 4 is a schematic illustration similar to that of FIG. 2 but showing a plurality of the modular units, according to an embodiment of the disclosure.

Referring generally to FIGS. 2-4, a schematic illustration is provided of modular manifold 22. As illustrated, the modular manifold 22 may be constructed with various populations of modular units 26. In this example, a single modular unit 26, a pair of modular units 26, and four modular units 26 are illustrated in FIGS. 2, 3 and 4, respectively. By way of example, the modular manifold 22 may comprise manifold base 24 combined with a manifold frame 36 constructed to create appropriate spaces 38, e.g. slots, with sufficient room for receiving corresponding modular units 26. Each modular unit 26 may be removably mounted to the base 24, frame 36, and/or other modular unit(s) 26 with suitable clamps, fluid couplings, or other engagement features. In some embodiments, remotely operated vehicles, autonomous underwater vehicles, robotic mechanisms, diver assisted tools, and/or other devices may be used to guide each modular unit 26 into position and to secure the modular unit at that position via actuation of, for example, a fluid coupling or other engagement feature.

The modularity provides an operator with great flexibility. For example, by installing the first modular unit 26 (see FIG. 2), the operator may begin producing from one of the wells 30 or performing another operation while considering the use of additional modular units 26. When the next modular unit 26 is deemed desirable and becomes available, it can be separately and individually installed within another space 38 of the same modular manifold 22, as illustrated in FIG. 3. Accordingly, the modular construction enables a modular approach to populating different spaces 38 of the modular manifold 22 with different modular units 26 in a staged or phased manner over time (or when otherwise desired) via addition and/or removal of selected modular units 26.

It should be noted that while FIGS. 2-4 illustrate one to four modular units 26 installed in the modular manifold 22, the modular manifold 22 may have different numbers of modular units 26 and may be constructed to accommodate greater numbers of modular units 26 by providing a greater number of spaces 38. In some embodiments, the number of spaces 38 may be adjustable by, for example, reconfiguring the modular manifold 22 or adding modular sections to the manifold 22. The modular units 26 also may be installed, removed, and/or reinstalled in various orders and sequences in various selected spaces 38.

In well applications, the modular units 26 may be in the form of modular branch units (MBUs), multiple modular branch units (MMBUs), and/or modular header units (MHUs). In some applications, one or more MHUs may be installed along modular base 24 and then one or more MBUs (and/or MMBUs) may be installed along modular base 24 and coupled with corresponding MHUs.

Figure 5:
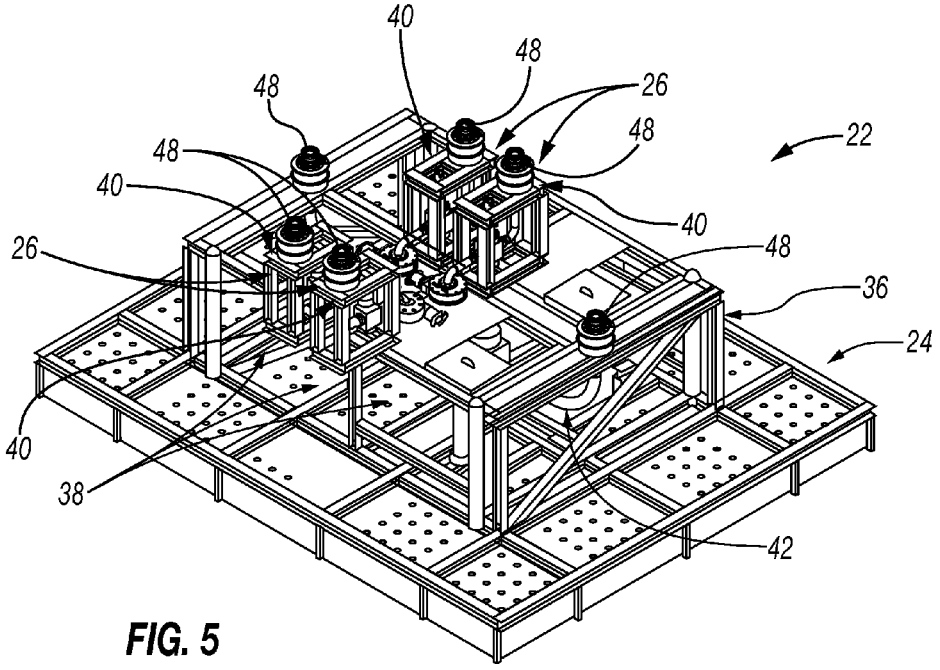
FIG. 5 is an orthogonal view illustrating an example of a modular manifold having a plurality of modular units installed, according to an embodiment of the disclosure.

Referring generally to FIG. 5, an embodiment of the modular manifold 22 is illustrated. In this example, the modular manifold 22 is populated by a plurality of modular units 26 in the form of modular branch units (MBUs) 40. According to the illustrated example, two pairs of MBUs 40 are illustrated, although modular manifold 22 may have various other numbers of MBUs 40 installed in desired spaces 38 along manifold base 24. The modular manifold 22 also may have spaces 38 of various sizes and arrangements to accommodate various numbers and types of modular units 26.

Each modular unit 26 may comprise combinations of valves, piping, integrated or non-integrated flowmeters, choke modules, sensors, and/or other components. In some embodiments, the MBUs 40 (and/or other modular units 26) may be coupled in fluid communication with other modular units 26. For example, MBUs 40 may be coupled with at least one modular header unit (MHU) 42 as illustrated.

Although FIG. 5 illustrates manifold frame 36 as defining spaces 38 for receiving the four MBUs 40, the frame 36 may comprise spaces 38, e.g. receptacles, which are left empty or filled with other types of modular units 26. The manifold frame 36 also may be constructed in various suitable sizes and configurations. Some embodiments may omit the manifold frame 36.

Figure 6:
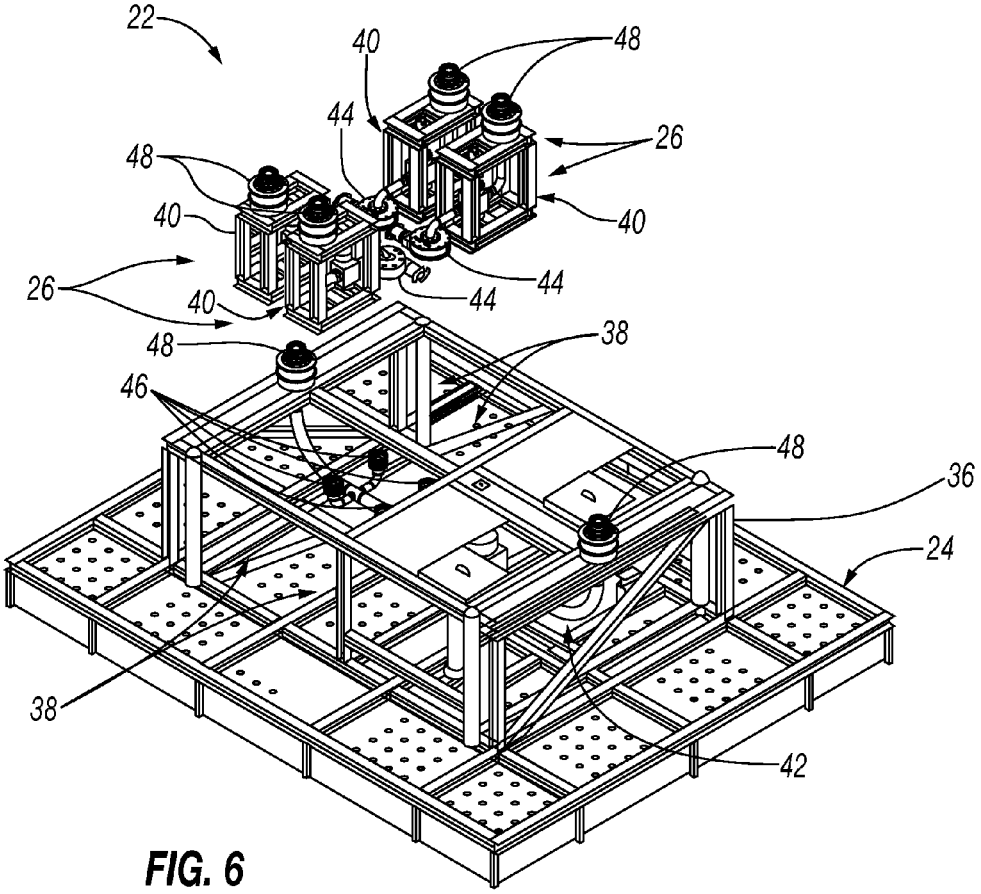
FIG. 6 is an orthogonal view similar to that of FIG. 5 but showing some of the modular units decoupled from the manifold base, according to an embodiment of the disclosure.
Figure 7:
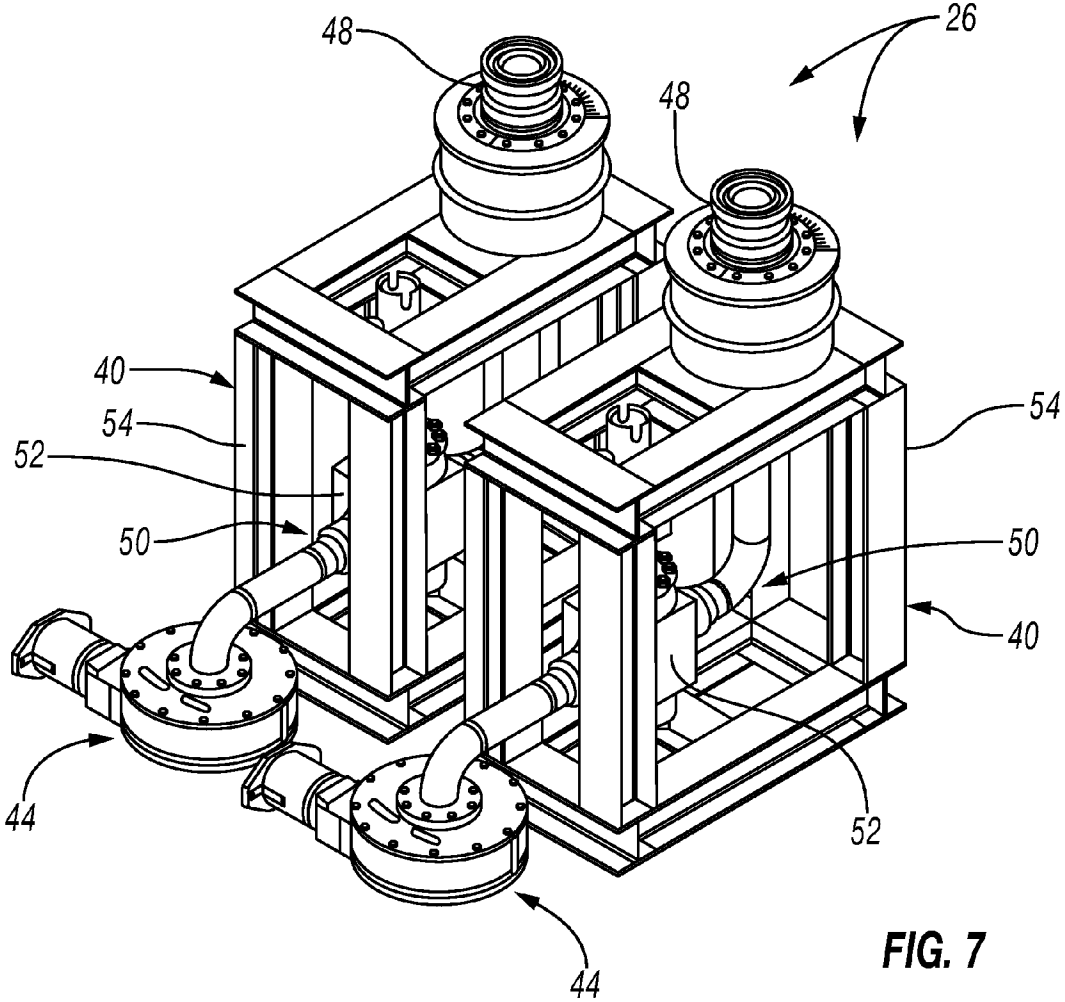
FIG. 7 is an orthogonal view illustrating an example of a modular unit, according to an embodiment of the disclosure.

With additional reference to FIGS. 6 and 7, each modular unit 26, e.g. each MBU 40, may comprise one or more connectors 44 for connection with one or more corresponding connectors 46. By way of example, the corresponding connectors 46 may be positioned on manifold base 24, manifold frame 36, on a header unit (as illustrated), or on another suitable component. In the specific example illustrated, the corresponding connectors 46 are located on the modular header unit (MHU) 42.

In some embodiments, each modular unit 26, e.g. each MBU 40, also may comprise at least one hub 48. Each hub 48 may be constructed for coupling with a corresponding pipeline or other flow line, e.g. a fluid conduit, well jumper, flexible jumper, rigid jumper, other type of jumper, gooseneck, umbilical, riser, and/or other type of line for transmission of fluid and/or electrical power. In turn, the flow lines, e.g. flow lines 28 or 34, may be constructed for communication with another system. In a subsea application, for example, at least one flow line 34 may be connected between a modular unit 26 and corresponding well installation 32, e.g. horizontal tree, vertical tree, a hybrid tree. However, individual modular units 26 also may be placed in communication with other types of well system components, such as a spool, pipeline end terminal (PLET), pipeline end manifold (PLEM), wellhead equipment, a processing module, an injection module, a sampling module, or other suitable components.

The connectors 44, 46 as well as the hubs 48 may be connected to corresponding components, e.g. modular units, and flow lines, e.g. pipelines, by way of a diver assisted or diverless remotely operated vehicle (ROV) or autonomous underwater vehicle (AUV). The hubs 48 and connectors 44, 46 also may comprise various types of connection systems such as clamp systems, collet systems, dog-based systems, flange systems, or other suitable connector mechanisms for achieving the desired fluid coupling of each modular unit 26. It should be noted the hubs 48 are illustrated as vertically oriented, however the hubs 48 as well as connectors 44, 46 may be oriented horizontally or at other suitable orientations for a given application.

In an operational example, the manifold base 24 may be installed at a desired location at the surface of the earth in a surface application or on the sea floor in a subsea application. The manifold frame 36 may be installed on the manifold base 24 and may be a separate component attached to the base 24 or integrally formed with the base 24. The manifold base 24 and manifold frame 36 may comprise additional equipment, e.g. additional subsea equipment, installed in spaces 28, e.g. installed in suitable receptacles, before and/or after the manifold base 24 is set in place. The manifold base 24 may be set in place with or without frame 36.

According to an embodiment, at least one MHU 42 may be installed into an appropriate space 38 and may provide one or more corresponding connectors 46 for coupling with other modular units 26. After installation of at least one MHU 42 along manifold base 24, a modular unit or units 26 may be deployed and coupled with the corresponding connectors 46. By way of example, at least one MBU 40 may be deployed and coupled with the corresponding MHU 42 via connectors 44 and corresponding connectors 46. Selected modular units 26 may be installed, removed, and/or replaced on an individual basis via an ROV/AUV, with a downline from a crane, with a robotic arm and/or manipulator on the manifold 22, and/or with other installation and removal tools and techniques.

With additional reference to FIG. 7, each MBU 40 is illustrated as having a single connector 44, however individual modular unit 26 may be constructed with various numbers of connectors 44 for coupling with corresponding connectors 46. In some embodiments, the multiple connectors 44 may be used for coupling with multiple components via corresponding connectors 46. For example, a single MBU 40 may be coupled with a plurality of MHUs 42 or vice versa.

Each modular unit 26 may comprise a flow circuit 50 which may include a flow control unit 52, e.g. a valve. By way of example, the valve 52 may be in the form of a gate valve, ball valve, check valve, needle valve, poppet valve, isolation valve, or other types of valves, with or without an actuator, to enable desired flow control. It should be noted the flow circuit 50 may comprise independent pipes; or flow passages may be formed in a solid material, e.g. milled or cast in a solid block. In the example illustrated, the flow circuit 50 is supported within a modular unit framework 54. The flow circuit 50 also may comprise additional valves and other components depending on the desired functionality of the modular unit 26.

Figure 8:
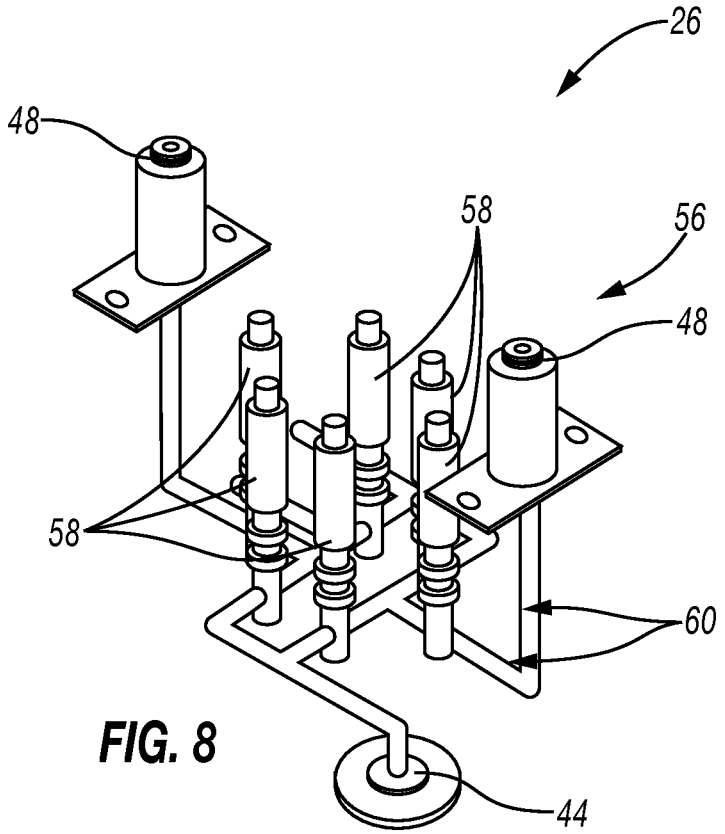
FIG. 8 is an orthogonal view illustrating another example of a modular unit, according to an embodiment of the disclosure.
Figure 9:
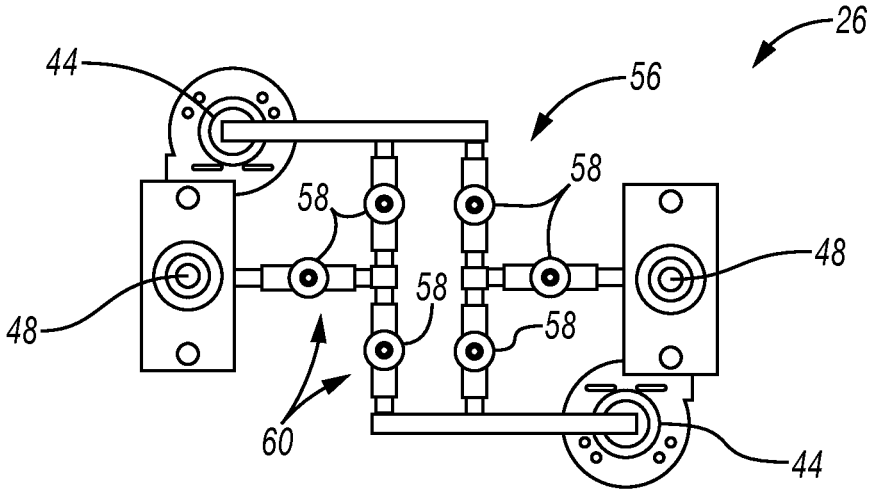
FIG. 9 is a top view on the modular unit illustrated in FIG. 8, according to an embodiment of the disclosure.

Referring generally to FIGS. 8 and 9, another embodiment of the modular unit 26 is illustrated. In this example, the modular unit 26 is illustrated in the form of a multiple modular branch unit (MMBU) 56 which may be selectively installed and removed from a corresponding space 38 of the modular manifold 22. In some embodiments, the MMBU 56 may include a supporting frame, such as framework 54 illustrated in FIG. 7.

The MMBU 56 also may have a plurality of hubs 48 for coupling with corresponding flow lines or components. In the illustrated example, the MMBU 56 comprises two hubs 48 but other embodiments may have a single hub 48 or a greater number of hubs 48, e.g. three, four, five, six, seven, eight, or more hubs 48. Depending on the application, each hub 48 may be coupled to a pipeline or other flow line, e.g. a fluid conduit, jumper, gooseneck, umbilical, riser, or other component. As described above, the flow lines may be connected to a variety of other components of the overall flow system, e.g. overall well system.

The MMBU 56 also may comprise at least one connector 44 which may be coupled with at least one corresponding connector 46. For example, the connector 44 of the MMBU 56 may be coupled with the corresponding connector 46 of an MHU 42. In some embodiments, the MMBU 56 may comprise at least one valve 58, e.g. a plurality of valves 58. The valves 58 may comprise various types of valves used for flow regulation, e.g. gate valves, ball valves, check valves, needle valves, poppet valves, isolation valves, or other types of valves with or without actuators. The valves 58 may be positioned along a flow circuit 60 which may comprise, for example, sections of tubing or may be formed in a solid supporting structure.

Figure 10:
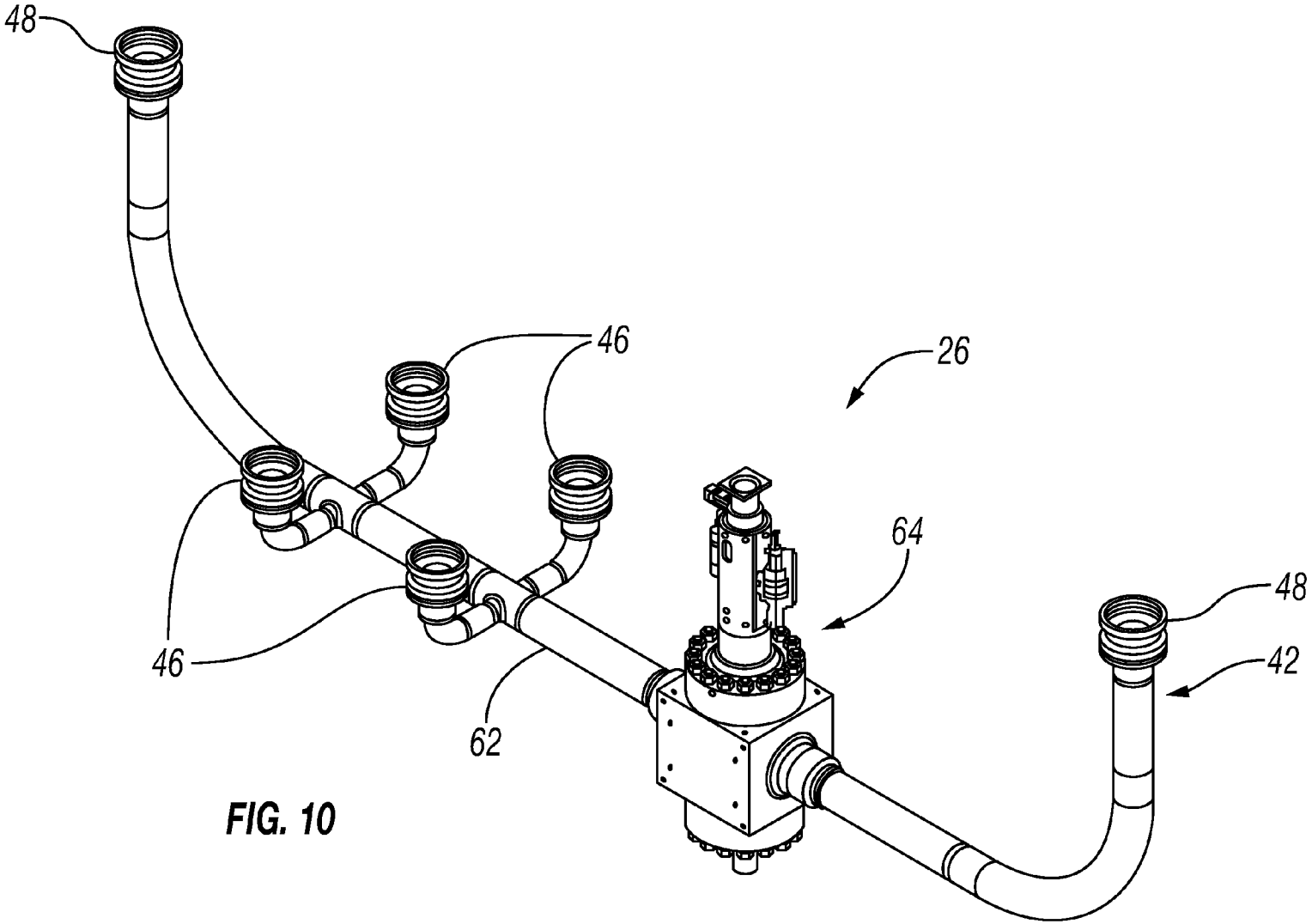
FIG. 10 is an orthogonal view illustrating another example of a modular unit, according to an embodiment of the disclosure.

Referring generally to FIG. 10, another modular unit 26 is illustrated in the form of modular header unit (MHU) 42 having corresponding connectors 46. Although four corresponding connectors 46 are illustrated, other numbers of corresponding connectors 46, e.g. fewer or greater numbers, may be positioned on either side of a flow pipe 62. By way of example, the corresponding connectors 46 may be arranged for coupling with connectors 44 of one or more MBUs 40 and/or one or more MMBUs 56. Depending on the application, the connectors 44 and corresponding connectors 46 may be in the form of hydraulic flanged connections or other suitable connections and may comprise mechanical, electrical, and hydraulic elements.

The MHU 42 also may comprise hubs 48 which provide connection points or tie-in-points for extension to a corresponding flow line, such as a pipeline or flow line jumper. In some embodiments, the MHU 42 also may comprise at least one valve 64 positioned along, for example, flow pipe 62. The valve or valves 64 may comprise various types of valves used for flow regulation, e.g. an isolation valve or an actuator-based valve. The valve(s) 64 may be positioned at desired locations to control flow with respect to specific connection points.

Figure 11:
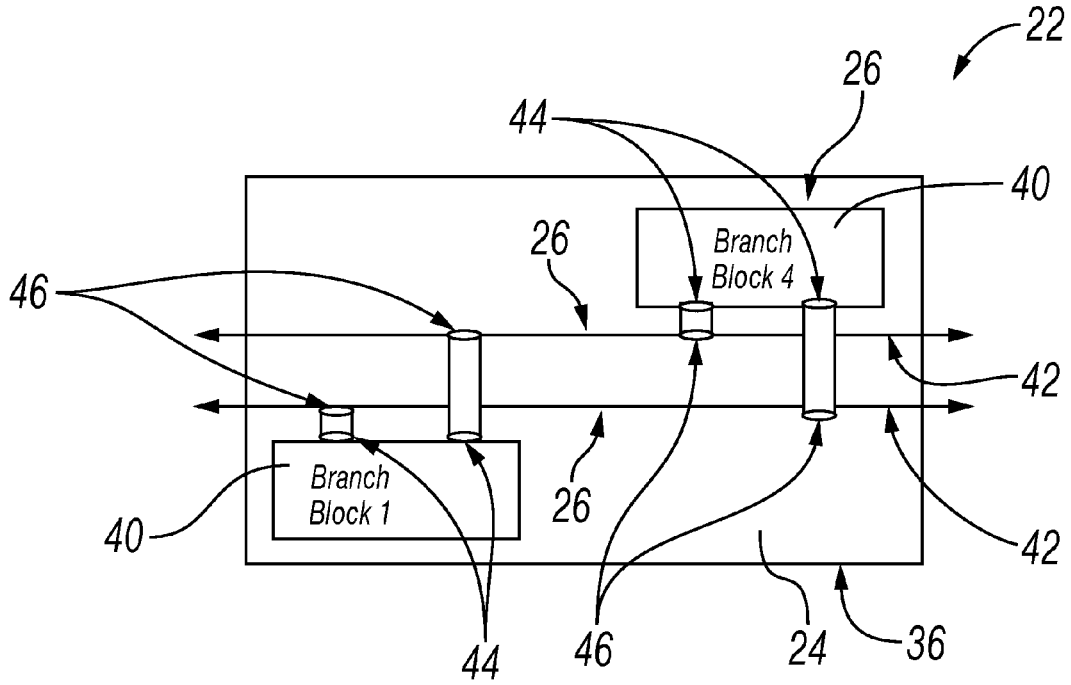
FIG. 11 is a schematic illustration of an example of a plurality of different types of modular units coupled into the modular manifold, according to an embodiment of the disclosure.

Referring generally to FIG. 11, a schematic top view is provided of an embodiment of the modular manifold 22. In this example, the modular manifold 22 illustrates a pair of the MBUs 40 positioned in corresponding spaces/slots 38 within frame 36 and along manifold base 24. The MBUs 40 each comprise connectors 44 which are coupled with corresponding connectors 46 of a pair of MHUs 42.

Depending on the application, the MBUs 40 may have various sizes and functionalities. For example, each MBU 40 may be constructed with various components and features to provide different functionalities, e.g. unique functionalities relative to other MBUs 40 of the modular manifold 22. Desired functionalities may be achieved via corresponding arrangements of components. Examples of such components include valves, hydraulic and/or electrical stabs (e.g. connection points for control systems or other systems), sensors, e.g. temperature/pressure sensors, monitoring systems, processing modules, pumps, process fluid turbines, injection components, chemical injection components, measurement devices, e.g. flow meters, constitution measurement devices, consistency measurement devices, gas separation devices, water separation devices, solid separation devices, hydrocarbon separation devices, sampling devices, and/or other selected devices to achieve the desired functionality or functionalities.

Additionally, functionalities may be achieved on the individual MBU 40 or via coupling with other devices through a corresponding hub or hubs 48. It should be noted the illustration of two MBUs 40 and two MHUs 42 is provided for purposes of explanation and other numbers of these and other modular units 26 may be employed in a given modular manifold 22.

Figure 12:
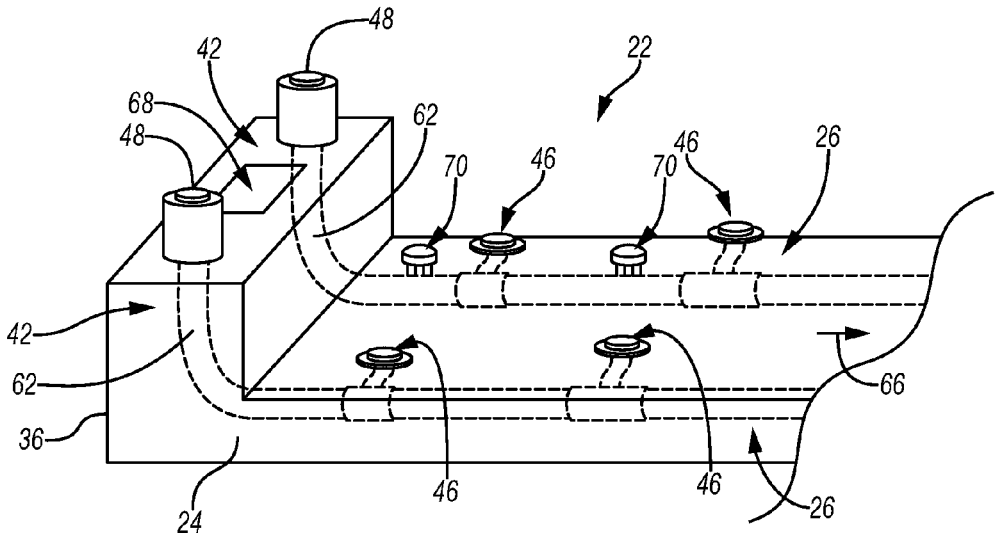
FIG. 12 is schematic illustration of an example of modular units coupled into the modular manifold, according to an embodiment of the disclosure.

Referring generally to FIG. 12, another embodiment of modular manifold 22 is illustrated. In this embodiment, the modular manifold 22 enables modular expansion via, for example, MBUs 40, MMBUs 56, and/or MHUs 42. The number of modular unit 26, e.g. MBUs 40, MMBUs 56, MHUs 42, may be selected according to the parameters of a given operation. Similarly, the connectors 44, corresponding connectors 46, and hubs 48 also may be selected according to the desired fluid flow control for a given operation.

In some embodiments, the number of corresponding connectors 46 may be expanded in a given direction, e.g. a direction indicated by arrow 66. The addition of corresponding connectors 46 may be used for fluid coupling to additional branch unit connectors 44 and/or to additional well slots, well hubs, booster pumps, and other system components. In some embodiments, more than one MHU 42 may share a corresponding connector 46 for coupling with connectors 44 of one or more MBUs 40 and/or MMBUs 56.

Because of the modularity of each type of modular unit 26, the number and arrangement of modular units 26, e.g. MBUs 40, MHUs 42, MMBU 56, may be readily changed over time. For example, modular units 26 may be installed, removed, and/or reinstalled as conditions change over the life of a field or project. In some embodiments, the modular manifold 22 also may comprise various other components, such as a control module 68 (e.g. a subsea control module (SCM) or control pod) which may supply hydraulic and/or electric power and/or signals with respect to the modular manifold 22. The modular manifold 22 also may comprise various electronic components used for control, communications, data gathering, or other desired functions. Additionally, the modular units 26, e.g. MHUs 42, may comprise one or more plates 70 for control/communication couplings, e.g. hydraulic stab plates.

Depending on the parameters of a given operation, the components and configurations of the modular manifold 22 and other components of the overall system 20 may vary. The modular manifold 22 may be used in subsea well operations, surface well operations, or other flow control operations which benefit from the modularity and thus the adjustable functionality of the modular manifold 22. Depending on the parameters of a given operation, the number and arrangement of modular units 26 may vary initially and throughout the life of the project.

The coupling and decoupling of modular unit 26 with respect to the modular manifold 22 and cooperating components may be performed by ROVs, AUVs, robotic mechanisms, operator assisted mechanisms, or other mechanisms depending on the connector type and the location of the modular manifold 22. In well related applications, the configuration and functionality of each MBU, MMBU, MHU may be selected according to the flow control desired for a given operation. The various modular units 26 also may comprise many other types of monitoring equipment, e.g. sensors, and other components to facilitate the overall operation.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for directing fluid flow, comprising:

a modular manifold disposed at a subsea location and coupled with a plurality of well installations and at least one other well system component via flowlines, the plurality of well installations and the at least one other well system component being located remotely from the modular manifold, the plurality of well installations being in fluid communication with a plurality of wells, the modular manifold serving solely as a manifold for conducting fluid flows passing through the modular manifold during a production operation, the module manifold having:

a manifold base;

a manifold frame combined with the manifold base, the manifold frame establishing a plurality of spaces; and a plurality of modular units mounted in corresponding spaces of the plurality of spaces, the modular units each having a plurality of connectors positioned to form a plurality of corresponding fluid couplings for directing fluid flow, each modular unit being placed in fluid communication with the manifold base which, in turn, is coupled with the flowlines; and the plurality of well installations being located separately from the manifold base and coupled with the modular manifold via the flow lines, the plurality of modular units being configured to control the fluid flows as the fluid flows move between the plurality of well installations and the at least one other well system component located remotely relative to the modular manifold.

2. The system as recited in claim 1, wherein the plurality of modular units comprises a modular branch unit.

3. The system as recited in claim 1, wherein the plurality of modular units comprises a multiple modular branch unit.

4. The system as recited in claim 1, wherein the plurality of modular units comprises a modular header unit.

5. The system as recited in claim 1, wherein the modular manifold is a subsea modular manifold.

6. The system as recited in claim 1, wherein the modular manifold is a surface modular manifold.

7. A system, comprising:

a plurality of well installations and at least one other type of well system component; and a modular manifold serving solely for directing fluid flows passing through the modular manifold, the modular manifold being coupled with the plurality of well installations and the at least one other type of well system component via flowlines, the plurality of well installations and the at least one other type of well system component being located remotely from the modular manifold, the plurality of well installations being in fluid communication with a plurality of wells, the modular manifold having:

a manifold base independent of other well system components;

a manifold frame, the manifold frame being a separate component from the manifold base and attachable to the manifold base to create a desired number of mounting spaces; and a plurality of modular units comprising at least one modular branch unit coupled with at least one modular header unit to direct fluid flows into or from at least one remotely located well installation of the plurality of well installations, the plurality of modular units being removably mounted along the manifold base, the manifold frame providing the mounting spaces within which different types of modular units may be removably mounted in a staged manner over time to provide flexibility in controlling fluid flows with respect to wells.

8. The system as recited in claim 7, wherein the plurality of modular units comprises at least one modular branch unit and at least one modular header unit.

9. The system as recited in claim 7, wherein the plurality of modular units comprises at least one multiple modular branch unit and at least one modular header unit.

10. The system as recited in claim 7, wherein the plurality of modular units comprises a plurality of modular branch units.

11. The system as recited in claim 7, wherein the plurality of modular units comprises different types of modular units.

12. The system as recited in claim 7, wherein the modular manifold is a subsea manifold coupled in fluid communication with a plurality of subsea well installations.

13. A method, comprising:

positioning a manifold, having a manifold base, at a subsea location as an independent manifold;

coupling the manifold with a plurality of well installations via flowlines, the plurality of well installations being located remotely from the modular manifold and being in fluid communication with a plurality of wells;

deploying a modular unit from a surface to the manifold base at the subsea location;

coupling the modular unit along the manifold base in a manner to provide control over a desired fluid flow;

deploying a second modular unit to the manifold base; and coupling the second modular unit along the manifold base in a manner to provide control over a desired second fluid flow;

subsequently deploying at least one additional modular unit to the manifold base to enable control over at least one additional fluid flow to thus provide a staged delivery of modular units as flow control parameters change over the life of a well project;

providing each of the modular unit, the second modular unit, and the at least one additional modular unit with a flow circuit having a flow control valve;

fluidly coupling the manifold with other well system components, located remotely relative to the manifold, via flowlines routed from the manifold to the well system components; and using the manifold solely for conducting fluid flows through the manifold including conducting the desired fluid flow and the desired second fluid flow.

14. The method as recited in claim 13, further comprising uncoupling at least one of the modular unit and the second modular unit for retrieval to the surface while the manifold base remains at the subsea location.

15. The method as recited in claim 13, further comprising connecting the modular unit to a flow line to enable fluid flow from a subsea well installation.

16. The method as recited in claim 13, wherein deploying the second modular unit comprises deploying a modular branch unit.

* * * * *